United States Patent [19]

Sakamoto

[11] 4,027,430

[45] June 7, 1977

[54] LOCKING JALOUSIE FRAME

[76] Inventor: Minoru Sakamoto, 3911 Nioi Place, Honolulu, Hawaii 96816

[22] Filed: Apr. 27, 1976

[21] Appl. No.: 680,798

[52] U.S. Cl. ..... 49/403
[51] Int. Cl.[2] ..... E06B 7/084
[58] Field of Search ..... 49/403, 371

[56] References Cited

UNITED STATES PATENTS

| | | | |
|---|---|---|---|
| 465,395 | 12/1891 | Stoeppelwerth et al. | 49/403 X |
| 2,394,059 | 9/1944 | Hite | 49/403 X |
| 2,581,465 | 1/1952 | Arnold | 49/403 X |
| 2,718,038 | 9/1955 | Moore | 49/403 |
| 2,760,242 | 8/1956 | Armstrong | 49/403X |
| 2,926,400 | 3/1960 | Mandel | 49/403 X |
| 3,499,246 | 3/1970 | Loukas | 49/371 X |

*Primary Examiner*—Philip C. Kannan
*Attorney, Agent, or Firm*—Clarence A. O'Brien; Harvey B. Jacobson

[57] ABSTRACT

A locking jalousie frame having a pair of longitudinally extending, spaced, substantially parallel side rails provided with fixed pivots supporting jalousie retaining cover assemblies. Each of the cover assemblies includes a sheath provided with a socket arranged for retainingly receiving an end of a slat. A filler member is insertable into and removable from the sheath independently of the slat for permitting installation and removal of the slat in an opposed pair of the sheaths, while removal of the filler member, and accordingly the slat, from the sheath can only be accomplished from the normally interior side of the jalousie so as to prevent surreptitious illegal entry through the jalousie.

8 Claims, 6 Drawing Figures

LOCKING JALOUSIE FRAME

BACKGROUND OF THE INVENTION

1. Field of the Invention

This invention relates generally to a locking jalousie frame, and particularly to a cover assembly for pivotally mounting slats of a jalousie in such a manner as to permit removal of the slats only from the interior of a building, and the like, in which the jalousie is installed.

2. Description of the Prior Art

A difficulty encountered with jalousies as conventionally constructed is that the individual slats are installed from the top of a slat-holding clip. The top side of the slat-holding clip is always open, with the result that when the jalousie window is not closed tightly, the slats can be removed piece by piece merely by lifting the slats out of their associated holding clips.

I am aware of the following patents that may be pertinent to the invention:

2,718,038; J. A. Moore; Sept. 20, 1955;
3,130,458; F. Zacharias, Apr. 28, 1964:
3,161,268; L. V. Bent, Dec. 15, 1964:
3,183,561; P. J. Spicer, May 18, 1965.

SUMMARY OF THE INVENTION

It is an object of the present invention to provide retaining elements for the slats of a jalousie which will permit removal if the slats only from a side of the jalousie which is normally disposed facing into the interior of a building, and the like, in which the jalousie is installed.

It is another object of the present invention to provide a locking jalousie frame which is more resistant to surreptitious illegal entry than jalousie frames now employed.

These and other objects are achieved according to the present invention by providing a jalousie frame including a cover assembly for retaining a slat on an associated side rail of the frame, with the cover assembly having: a sheath provided with a slat-receiving socket; a filler member removably disposed in the socket for limiting the distance of insertion of an end of a slat into the socket; and an access opening, advantageously in the form of a cut-out portion, provided in the sheath for permitting insertion of the filler member into a removal from the socket when a slat is being retained in the socket.

According to a preferred embodiment of the invention, the sheath has an elongated cross section, and is further provided with an end wall disposed adjacent an associated side rail, an open end forming an entrance to the socket, a pair of edge walls extending substantially perpendicularly from the end wall to the open end, and a pair of substantially planar side walls connected to the end wall and edge walls for defining a long dimension of the cross section of the socket provided in the sheath. The sheath is still further provided with the aforementioned cut-out portion on one of the edge walls thereof, with the cut-out portion extending from the end wall toward the open end and forming a passage for inserting the filler member into and removing it from the socket of the sheath independently of the presence of a slat in the socket.

The filler member can be removably retained within the socket of the sheath by providing one of the side walls of the sheath with a slot communicating with the socket. A longitudinal extent of the slot should be oriented extending parallel to the long dimension of the cross section of the socket. The filler member is provided with a screw-threaded hole which receives a screw disposed in the slot for retaining the filler member in the sheath. By unscrewing the screw a few turns so that the head of the screw is spaced slightly from the surface of the side wall in which the slot is provided, the filler member may be lifted by means of the screw the length of the slot so as to partially remove the filler member from the socket provided in the sheath and facilitate removal of the filler member from the socket once the screw is completely removed from the associated screw-threaded hole provided in the filler member.

In order to assure good engagement between the slat and the sheath retaining an end of the slat, at least one, and preferably a plurality, of substantially V-shaped ribs are arranged extending along the walls of the socket for assuring a tight fit between the end of the slat and the socket.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
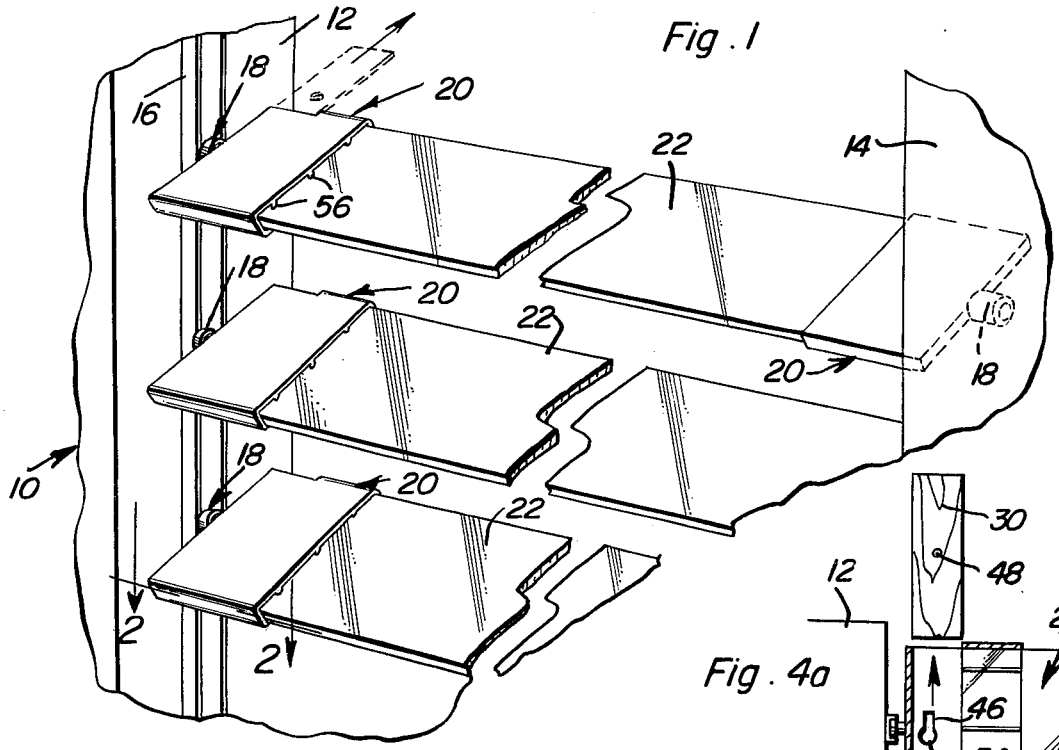
FIG. 1 is a fragmentary, perspective view showing a locking jalousie frame according to the present invention.

Referring now more particularly to FIG. 1 of the drawing, a locking jalousie frame 10 according to the invention includes a pair of longitudinally extending, spaced, substantially parallel side rails 12 and 14. Extending along the longitudinal length of these rails 12 and 14 is a, for example, channel 16, only one of which is shown, having provided in there a plurality of fixed pivots 18 of conventional construction and pivotally mounting a plurality of cover assemblies 20 according to the present invention. It is to be understood that the particular arrangement of hardware represented by channel 16 and pivtos 18 as shown in the drawing are illustrative only, and that any conventional hardware can be employed for the purpose of providing fixed pivots for the cover assembly 20.

Each of the cover assemblies 20 is attached to a fixed pivot 18 of an associated rail 12, 14, and retainingly supports an end of a slat 22 which forms the panes of the jalousie. Slats 22 are of a conventional construction, usually glass sheets, and are identical to the slats employed in commercially available jalousie units.

Figure 2:
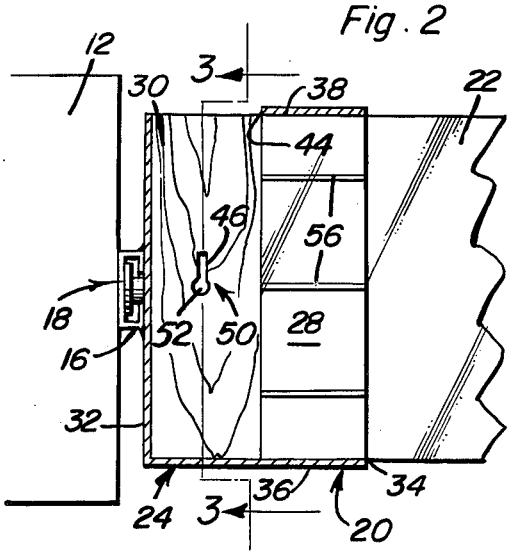
FIG. 2 is a fragmentary, vertical sectional view taken generally along the line 2—2 of FIG. 1.
Figure 3:
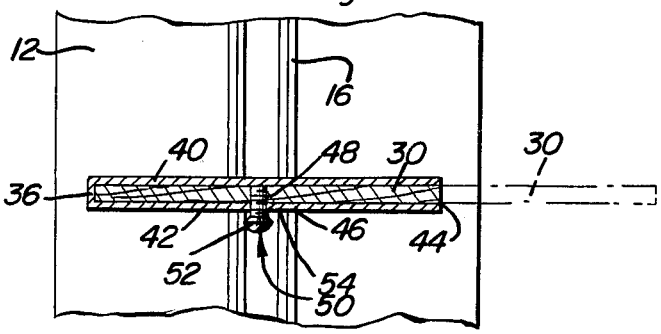
FIG. 3 is a fragmentary, sectional view taken generally along the line 3—3 of FIG. 2.

Referring now more particularly to FIGS. 2 and 3 of the drawing, a cover assembly 20 includes a sheath 24 provided with a socket 26 which receives an end 28 of a slat 22 for retainingly holding the end 28 from movement relative to sheath 24. Also disposed within socket 28 in such a manner as to be insertable and removable independently of the presence of end 28 of a slat 22 is a filler member 30, advantageously in the form of the illustrated block of wood, and the like. Sheath 24 is itself preferably constructed from a suitable metal, such as aluminum and the like.

Sheath 24 is further provided with an end wall 32, an open end 34 forming an entrance to the socket 26, a pair of edge walls 36 and 38 extending substantially perpendicularly fom the end wall 32 to the open end 34, and a pair of substantially planar side walls 40 and 42 connected to the end wall 32 and the edge walls 36 and 38 for defining a long dimension of the elongated cross section of the socket 26 provided in sheath 24. The latter is still further provided with a cut-out portion 44 on one of the edge walls 36, 38, with the edge wall 38 being illustrated as so provided in the drawing. Cut-out portion 44 extends from the end wall 32 toward the open end 34, but not reaching the open end 34, for forming a passage which permits insertion and removal of filler member 30 into and out of socket 26 even when an end 28 of a slat 22 is present within the socket 26.

As will be appreciated, the presence of filler member 30 spaces the end 28 of a slat 22 from the end wall 32 of sheath 24 when slat 22 is installed in frame 10 for normal usage. When it is desired to remove a slat 22 from the frame 10, however, filler member 30 must first be removed from socket 26 as by passing member 30 through the cut-out portion 44.

Sheath 24 is yet further provided with a slot 46 in one of the side walls 40, 42, with side wall 40 being so provided in the drawing. This slot 46 communicates with the socket 26, and is oriented so that the longitudinal extent of the slot 46 is parallel to the long dimension of the cross section of socket 26 provided in sheath 24. In addition, filler member 30 is provided, in a central face portion thereof, with a through, screw-threaded hole 48 which threadingly receives a screw 50 disposed in slot 46 for retaining the filler member 30 in sheath 24 during normal usage of frame 10.

Accordingly, when it is desired to remove filler member 30 from socket 26, screw 50 must first be removed from its cooperating screw-threaded hole 48. According to a particularly advantageous feature of the present invention, screw 50 is provided with a flat head 52 normally engaging in an enlarged portion 54 provided at, for example, the end of slot 46 disposed farthest from the cut-out portion 44. Thus, by turning screw 50 a few turns in the direction of unscrewing of the screw, the head 52 will be removed from the enlarged portion 54 such that the shank of screw 50 will be permitted to pass along the extent of slot 46 toward the cut-out portion 44. In this manner, screw 50 can be employed as a tool for moving filler member 30 partially out of socket 26 at cut-out portion 44 such that filler member 30 can be manually grasped, in a manner not shown, and completely removed from socket 26 once the screw 50 has been completely unthreaded from hole 48. The broken lines in FIG. 3 show filler member 30 in a partially withdrawn position from socket 26.

Sheath 24 is also provided, in a portion of socket 26 extending from open end 34 to cut-out 44, with at least one, and preferably with the illustrated plurality, V-shaped ribs 56 having an apex arranged for engaging the surface of slat 22 and assuring a tight fit between the slat 22 and socket 26.

Figure 4A:
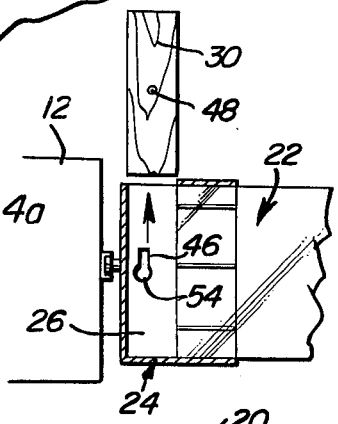
FIGS. 4*a*, 4*b*, and 4*c* are schematic representations, taken in horizontal sections similar to that of FIG. 2, showing a sequence of steps employed in removing an end of a slat from it associated retaining member of a locking jalousie frame according to the present invention.
Figure 4B:
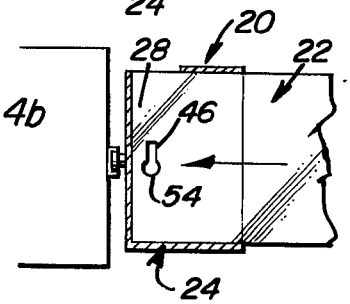
Figure 4C:
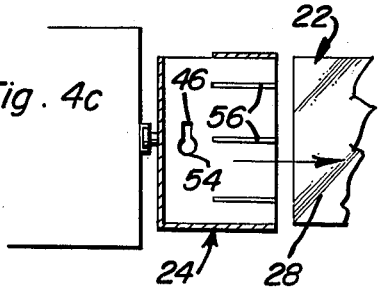

Referring now to FIGS. 4*a*, 4*b*, and 4*c*, removal of a slat 22 from an associated cover assembly 20 will now be described. It is to be understood that insertion of a slat 22 into a cover assembly 20 will follow the opposite sequence of steps as set forth herein.

Once screw 50 has been completely removed from hole 48 of filler member 30, filler member 30 can be completely removed from socket 26, as shown in FIG. 4a. Subsequently, the end 28 of the slat 22 can be moved to the left as seen in FIG. 4b in order to remove the opposite end (not shown) of slat 22 from a sheath 24 included in the cover assembly 20 opposed to the cover assembly 20 shown in FIG. 4b. Once the opposite end of the slat 22 is free from its associated cover assembly 20, the end 28 of slat 22 may be removed from its associated cover assembly 20 simply by moving slat 22 toward the right as is shown in FIG. 4c. Thus, slat 22 has now been removed from frame 10, and may be replaced by a new slat or subsequently replaced as desired.

When replacing a slat 22, first one end of slat 22 is inserted into socket 26 and brought into abutting relationship with the end wall 32 of the sheath 24 forming the associated socket. Next, the opposite end of the slat 22 will be inserted into a socket 26 of a sheath 24 associated with that end of the slat and the slat centered in the respective sockets 26. Now, the filler members 30 may be inserted through the cut-out portions 44 provided in the respective sheaths 24 in order to prevent the slat 22 from shifting relative to their retaining cover assemblies 20. Filler members 30 may be locked in place as by the use of screws 50, and the slat 22 rigidly mounted on the side rails 10, 12 in a simple, yet rugged, reliable, and generally tamper-proof manner. As will be appreciated, once installed, the slats 22 can be removed only from the side, which is usually the side on the interior of a building and the like in which the jalousie is installed, on which the screws 50 and associated slots 46 are disposed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A locking jalousie frame, comprising, in combination:

a. a pair of longitudinally extending, spaced, substantially parallel side rails;

b. a cover assembly attached to one of the side rails and including a sheath provided with a socket, the socket being provided with an end wall disposed adjacent the associated side rail, an open end forming an entrance to the socket, a pair of edge walls extending substantially perpendicularly from the end wall to the open end, and a pair of substantially planar side walls connected to the end wall and edge walls;

c. a slat having a pair of longitudinally spaced ends with one of the ends being disposed in the socket provided in the sheath for retention by the sheath; and d. a filler member removably disposed in the socket provided in the sheath between the one of the ends of the slat and the associated side rail for spacing the slat from the side rail, the sheath being further provided with a cut-out portion on one of the edge walls, with the cut-out portion extending from the end wall toward the open end and forming a passage for inserting the filler member into and out of the socket provided in the sheath when the end of the slat is disposed in the socket so as to block the open end of the socket.

2. A locking jalousie frame, comprising, in combination:

a. a pair of longitudinally extending, spaced, substantially parallel side rails;

b. a cover assembly attached to one of the side rails and including a sheath provided with a socket; and c. a slat having a pair of longitudinally spaced ends, with one of the ends being disposed in the socket provided in the sheath for retention by the sheath, the cover assembly further including a filler member removably disposed in the socket provided in the sheath between the one of the ends of the slat and the associated side rail for spacing the slat from the side rail, the socket provided in the sheath having an elongated cross section, and the sheath being further provided with an end wall disposed adjacent the associated side rail, an open end forming an entrance to the socket, a pair of edge walls extending substantially perpendicularly from the end wall to the open end, and a pair of substantially planar side walls connected to the end wall and edge walls for defining a long dimension of the cross section of the socket provided in the sheath, the sheath being further provided with a cut-out portion on one of the edge walls, with the cut-out portion extending from the end wall toward the open end and forming a passage for inserting the filler member into and out of the socket provided in the sheath when the end of the slat is disposed in the socket.

3. A structure as defined in claim 2, wherein there are a pair of cover asemblies, one of the cover assemblies being pivotally mounted on a fixed pivot provided in a respective one of the side rails and the other of the cover asssemblies being pivotally mounted on a fixed pivot provided in the other of the side rails.

4. A structure as defined in claim 2, wherein the sheath is further provided with a slot in one of the side walls thereof, the slot communicating with the socket and oriented extending parallel to the long dimension of the cross section of the socket provided in the sheath, with the cover assembly further including the filler member being provided with a screw-threaded hole and including a screw, with the screw being disposed in the slot and threadingly engaged in the hole for retaining the filler member in the socket provided in the sheath.

5. A structure as defined in claim 4, wherein the screw has a flat head, and the slot includes an enlarged portion arranged at an end of the slot disposed farthest from the cut-out portion for receiving the head of the screw and restraining the screw and filler member from movement along the extent of the slot, the screw forming a filler member lifting element when the head of the screw is disposed clear of the associated side wall of the sheath.

6. A structure as defined in claim 4, wherein the sheath is provided, in a portion of the socket extending from the open end to the cut-out, with at least one V-shaped rib having an apex arranged for assuring a tight fit between the end of the slat and the socket of the sheath.

7. A structure as defined in claim 6, wherein the screw has a flat head, and the slot includes an enlarged portion arranged at an end of the slot disposed farthest from the cut-out portion for receiving the head of the screw and restraining the screw and filler member from movement along the extent of the slot, the screw forming a filler member lifting element when the head of the screw is disposed clear of the associated side wall of the sheath.

8. A structure as defined in claim 7, wherein there are a pair of cover assemblies, one of the cover assemblies being pivotally mounted on a fixed pivot provided on one of the side rails and the other of the cover assemblies being pivotally mounted on a fixed pivot provided on the other of the side rails, and also includes a pair of filler members, one of the filler members being removably disposed in the one of the cover assemblies and the other of the filler members being removably disposed in the other of the cover assemblies, the filler members cooperating to prevent the slat from shifting relative to the sheaths in which the slat is retained.

* * * * *